US008615928B2

(12) United States Patent
Wang

(10) Patent No.: US 8,615,928 B2
(45) Date of Patent: Dec. 31, 2013

(54) SAFETY GATE

(71) Applicant: Tsung-Hsiang Wang, New Taipei (TW)

(72) Inventor: Tsung-Hsiang Wang, New Taipei (TW)

( * ) Notice: Subject to any disclaimer, the term of this patent is extended or adjusted under 35 U.S.C. 154(b) by 0 days.

(21) Appl. No.: 13/761,281

(22) Filed: Feb. 7, 2013

(65) Prior Publication Data

US 2013/0221304 A1 Aug. 29, 2013

(30) Foreign Application Priority Data

Feb. 23, 2012 (CN) ..... 2012 2 0060668

(51) Int. Cl.
*E05D 15/06* (2006.01)

(52) U.S. Cl.
USPC ..... 49/226; 49/55; 49/57; 49/465

(58) Field of Classification Search
USPC ..... 49/55, 57, 463, 465, 50, 56, 61, 63, 67, 49/226, 234
See application file for complete search history.

(56) References Cited

U.S. PATENT DOCUMENTS

| | | | | |
|---|---|---|---|---|
| 5,809,694 | A * | 9/1998 | Postans | 49/57 |
| 6,112,461 | A * | 9/2000 | Cheng | 49/55 |
| 6,176,042 | B1 * | 1/2001 | Rossman et al. | 49/463 |
| 6,446,395 | B2 * | 9/2002 | Rogers | 49/463 |
| 6,715,182 | B2 * | 4/2004 | Cheng | 16/280 |
| 7,152,372 | B2 * | 12/2006 | Cheng | 49/465 |
| 7,334,624 | B2 * | 2/2008 | Waldman et al. | 160/144 |
| 7,540,046 | B1 * | 6/2009 | Lai | 5/100 |
| 7,874,103 | B2 * | 1/2011 | Yates | 49/57 |
| 8,341,886 | B2 * | 1/2013 | Yates | 49/55 |
| 2004/0045222 | A1 * | 3/2004 | Hicks | 49/394 |
| 2012/0324792 | A1 * | 12/2012 | Bertsch et al. | 49/37 |

* cited by examiner

*Primary Examiner* — Jerry Redman
(74) *Attorney, Agent, or Firm* — Rosenberg, Klein & Lee

(57) ABSTRACT

A safety gate has a doorframe, a fence door and a repositioning unit. The doorframe has a base frame, a first side frame, and a second side frame. The repositioning unit is mounted on a bottom of the fence door and has a repositioning recess. The repositioning recess selectively engages a top of the base frame and has two opposite guiding surfaces. When the fence door is open at an angle under 5 degrees relative to the doorframe, one of the guiding surfaces abuts a side of the top of the base frame. Because the guiding surface is curved and inclined relative to the fence door and because a distance between the guiding surfaces is decreased gradually, the guiding surface gradually rotates the fence door to close. As a result, the repositioning unit can close the fence door that is open slightly at a small angle.

20 Claims, 20 Drawing Sheets

SAFETY GATE

BACKGROUND OF THE INVENTION

1. Field of the Invention

The present invention relates to a safety gate, especially to a safety gate that can be closed automatically when the safety gate is open slightly at a small angle.

2. Description of the Prior Arts

A safety gate is installed at an entrance to household areas that might be unsafe, such as kitchen, stairs, or bathrooms to keep babies or young children from entering. The safety gate has a doorframe and a fence door. The fence door is connected pivotally to the doorframe. The fence door can be pushed by a user to open or close the gate, and the fence door also can be locked with the doorframe such that the babies or young children cannot push the fence door open.

A conventional safety door further has a resilient element mounted between the doorframe and the fence door. When the fence door is open, the resilient element is compressed. Then the compressed resilient element is extended by a resilient force and automatically rotates the fence door relative to the doorframe. After the fence door is rotated to close, the fence door is locked with the doorframe automatically.

However, when the fence door of the conventional safety gate is open at a small angle, the resilient element is only slightly compressed. Thus, the resilient force is not big enough to rotate the fence door to close the gate, and the fence door is not locked with the doorframe, either. The parents may yet falsely regard the fence door locked since there is only a small angle between the fence door and the doorframe. Then the babies or young children may push to open the unlocked fence door and enter the unsafe area.

To overcome the shortcomings, the present invention provides a safety gate to mitigate or obviate the aforementioned problems.

SUMMARY OF THE INVENTION

The main objective of the present invention is to provide a safety gate that can be closed automatically when the safety gate is open slightly at a small angle.

The safety gate has a doorframe, a fence door and a repositioning unit. The doorframe has a base frame, a first side frame and a second side frame. The side frames are vertically mounted on the base frame. The fence door is rotatably connected to the first side frame in an axially moveable manner. The repositioning unit is mounted on a bottom of the fence door and has a repositioning recess. The repositioning recess communicates with the exterior environment via two ends of the repositioning unit and selectively engages a top of the base frame. The repositioning recess has two opposite guiding surfaces and the guiding surfaces are curved and inclined relative to the fence door. A distance between the guiding surfaces is decreased gradually along a direction from the first side frame to the second side frame, and is decreased gradually from bottom to top.

When the fence door is open at an angle under 5 degrees relative to the doorframe, one of the guiding surfaces of the repositioning unit abuts a side of the top of the base frame. Because the guiding surface is curved and inclined relative to the fence door and because the distance between the two guiding surfaces is decreased gradually along the direction from the first side frame to the second side frame, the guiding surface gradually rotates the fence door to the doorframe. The fence door is rotated to close and is locked with the doorframe. As a result, the repositioning unit can close the fence door that is open slightly at a small angle.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
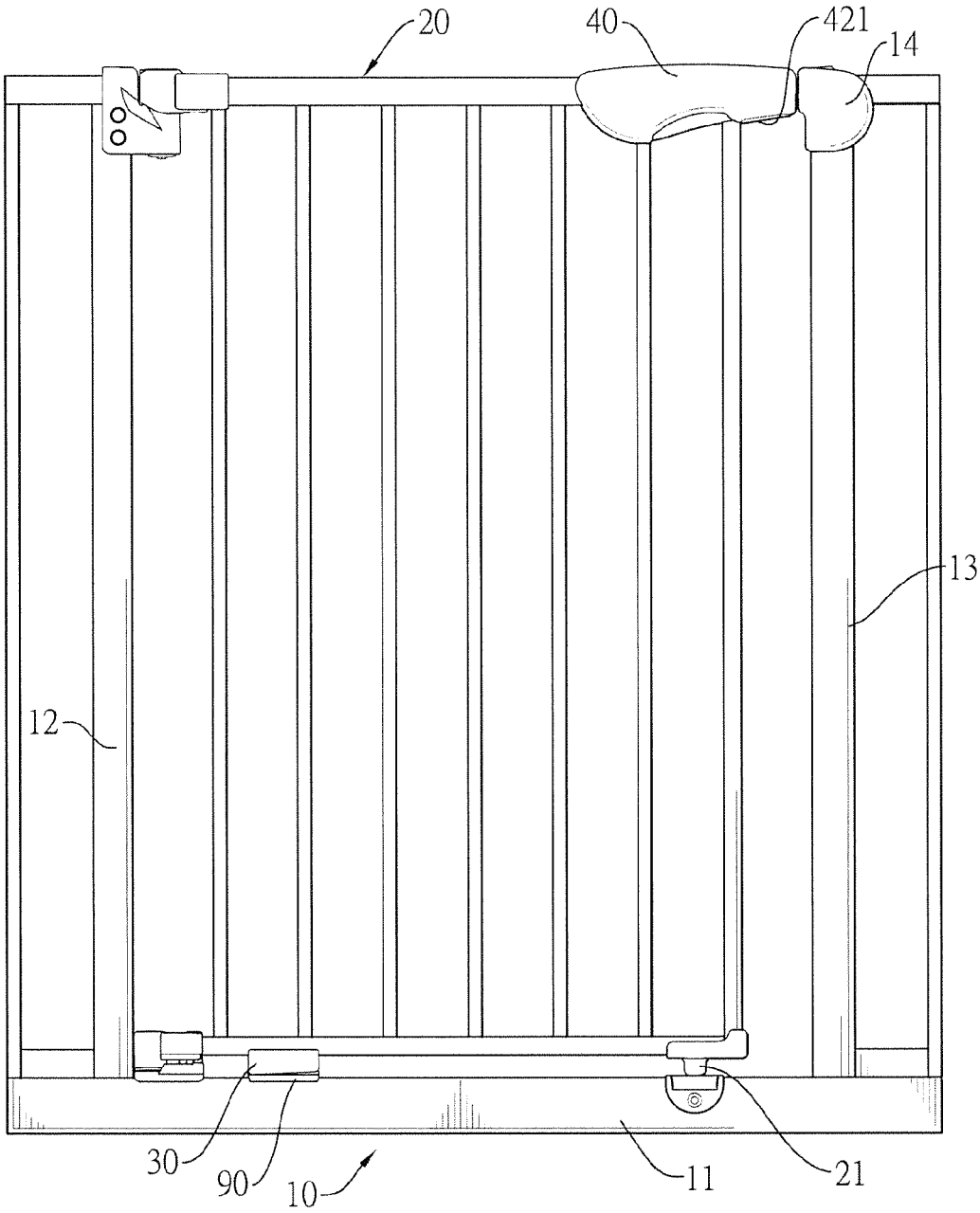
FIG. 1 is a front view of a first embodiment of a safety gate in accordance with the present invention.
Figure 2:
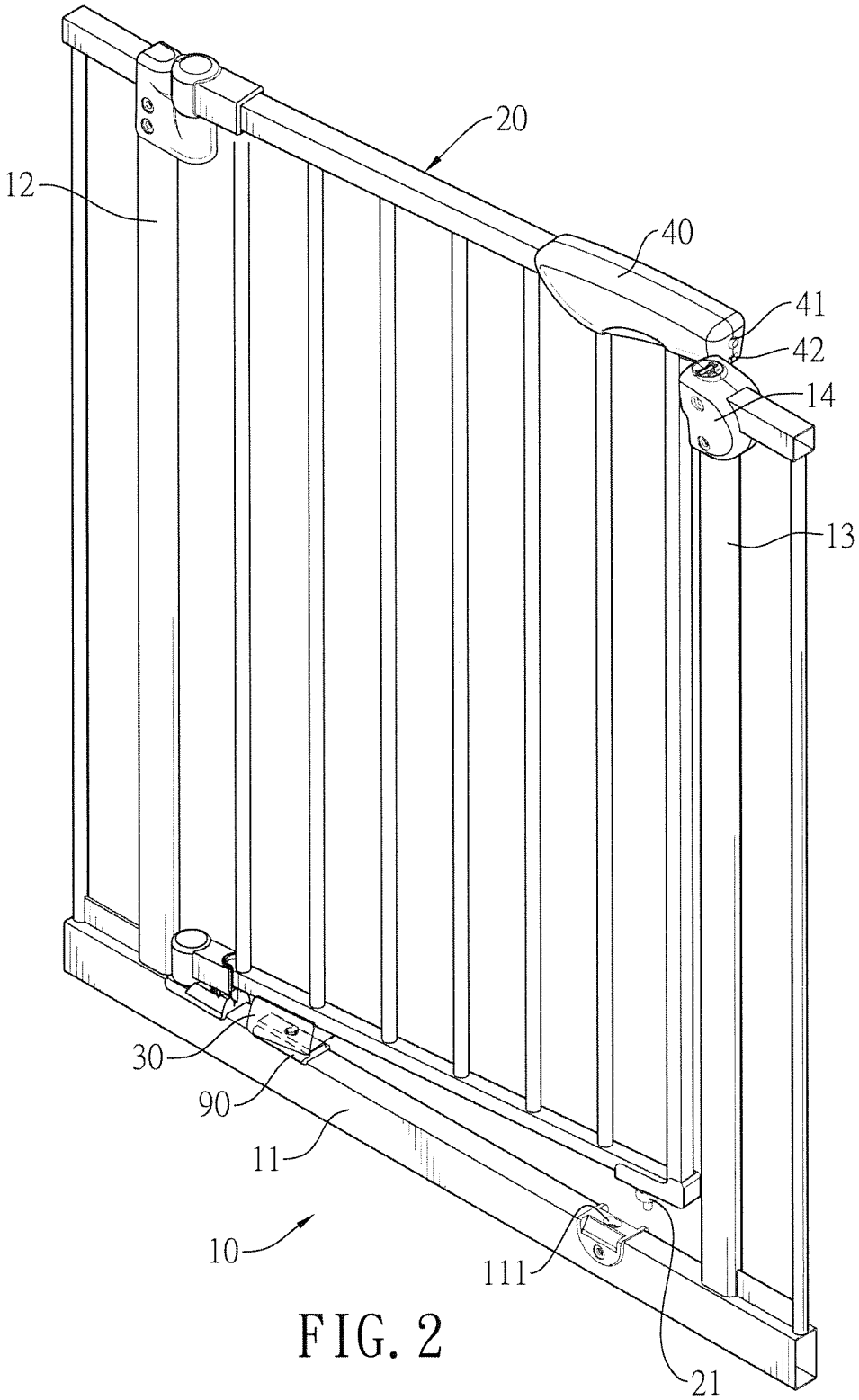
FIG. 2 is a perspective view of the safety gate in FIG. 1.

With reference to FIGS. 1 and 2, a first embodiment of a safety gate in accordance with the present invention comprises a doorframe 10, a fence door 20, a repositioning unit 30 and a repositioning seat 90.

The doorframe 10 has a base frame 11, a first side frame 12 and a second side frame 13. The base frame 11 has two ends. The first side frame 12 is vertically mounted on one of the ends of the base frame 11. The second side frame 13 is vertically mounted on the other one of the ends of the base frame 11. A gate opening is formed between the side frames 12, 13. In a preferred embodiment, the base frame 11 has a lock recess 111 disposed in a top of the base frame 11 and adjacent to the second side frame 13.

The fence door 20 has a first side and a second side. The first side is rotatably connected to the first side frame 12 in an axially moveable manner. The second side is opposite to the first side. The fence door 20 is rectangular. A width of the fence door 20 corresponds to a width between the first side frame 12 and the second side frame 13. The fence door 20 has multiple bars longitudinally mounted inside the fence door 20 and mounted at intervals. In a preferred embodiment, the fence door 20 has a lock plunger 21. The lock plunger 21 is mounted on a bottom of the fence door 20, is adjacent to the second side frame 13, and selectively engages in the lock recess 111 of the base frame 11.

Figure 3:
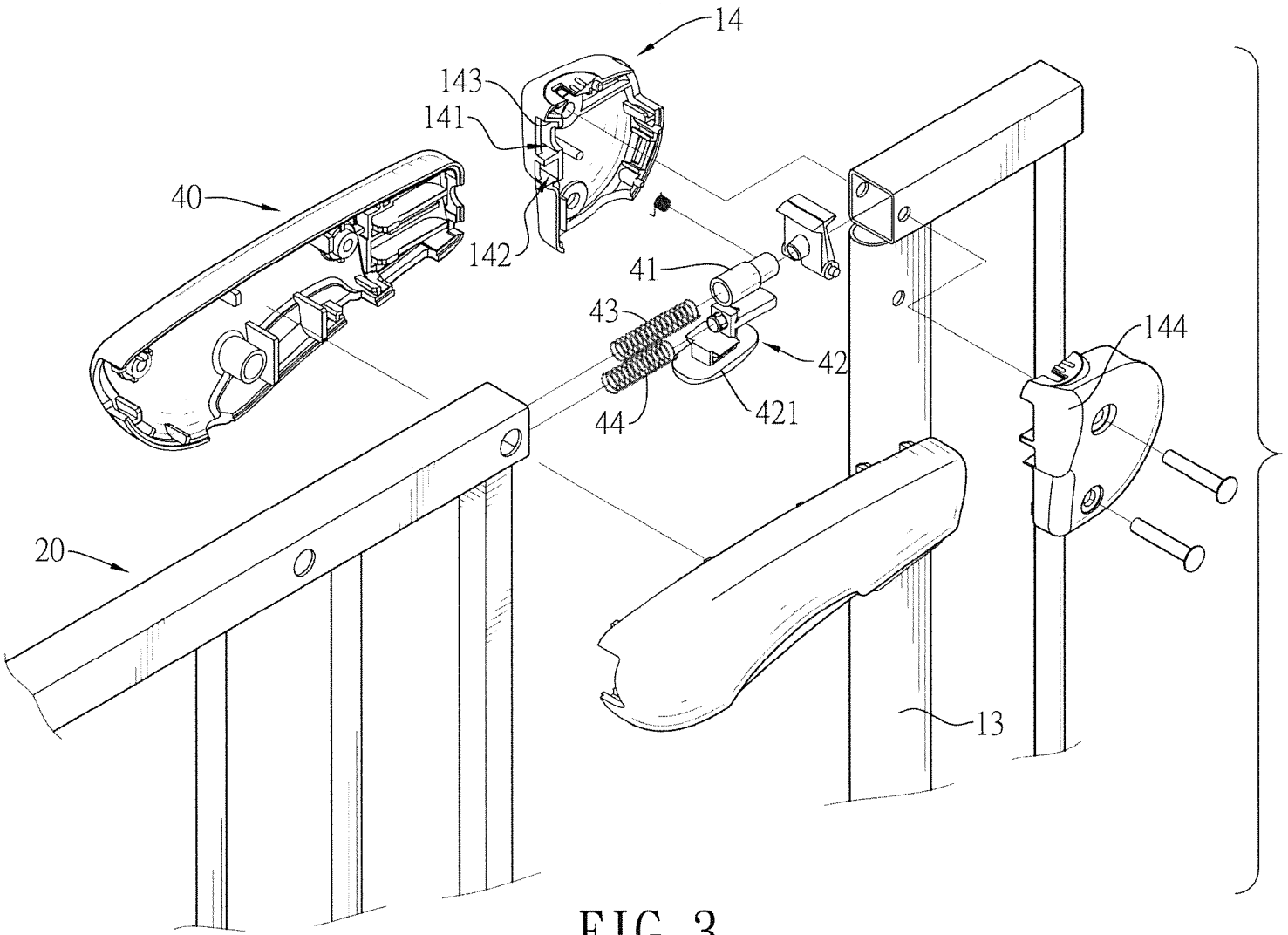
FIG. 3 is an exploded perspective view of a lock assembly of the safety gate in FIG. 1.

With reference to FIGS. 1 to 3, in a preferred embodiment, the second side frame 13 has a receiver 14 mounted on a side of a top of the second side frame 13. The receiver 14 has a first hole 141 and a second hole 142. The first hole 141 and the second hole 142 face the first side frame 12. The first hole 141 is disposed above the second hole 142. An unlocking inclined surface 143 is formed on a top of the first hole 141 and is inclined upward from inside to outside of the first hole 141. Two abutting surfaces 144 are each respectively formed on two opposite sides relative to the first hole 141 and the second hole 142. The abutting surfaces 144 are curved.

In a preferred embodiment, the fence door 20 further has a lock assembly 40. The lock assembly 40 is mounted on the second side of the fence door 20 and has a first latch 41, a second latch 42, a first spring 43 and a second spring 44. The first spring 43 pushes the first latch 41 such that the first latch 41 is telescopic. The first latch 41 is pushed for being selectively mounted in the first hole 141 of the second side frame 13. The second spring 44 pushes the second latch 42 such that the second latch 42 is telescopic. The second latch 42 is pushed for being selectively mounted in the second hole 142 of the second side frame 13. The second latch 42 has a pusher 421 mounted on a bottom of the second latch 42 and protruding out of a bottom of the lock assembly 40 as shown in FIG. 1.

Figure 4:
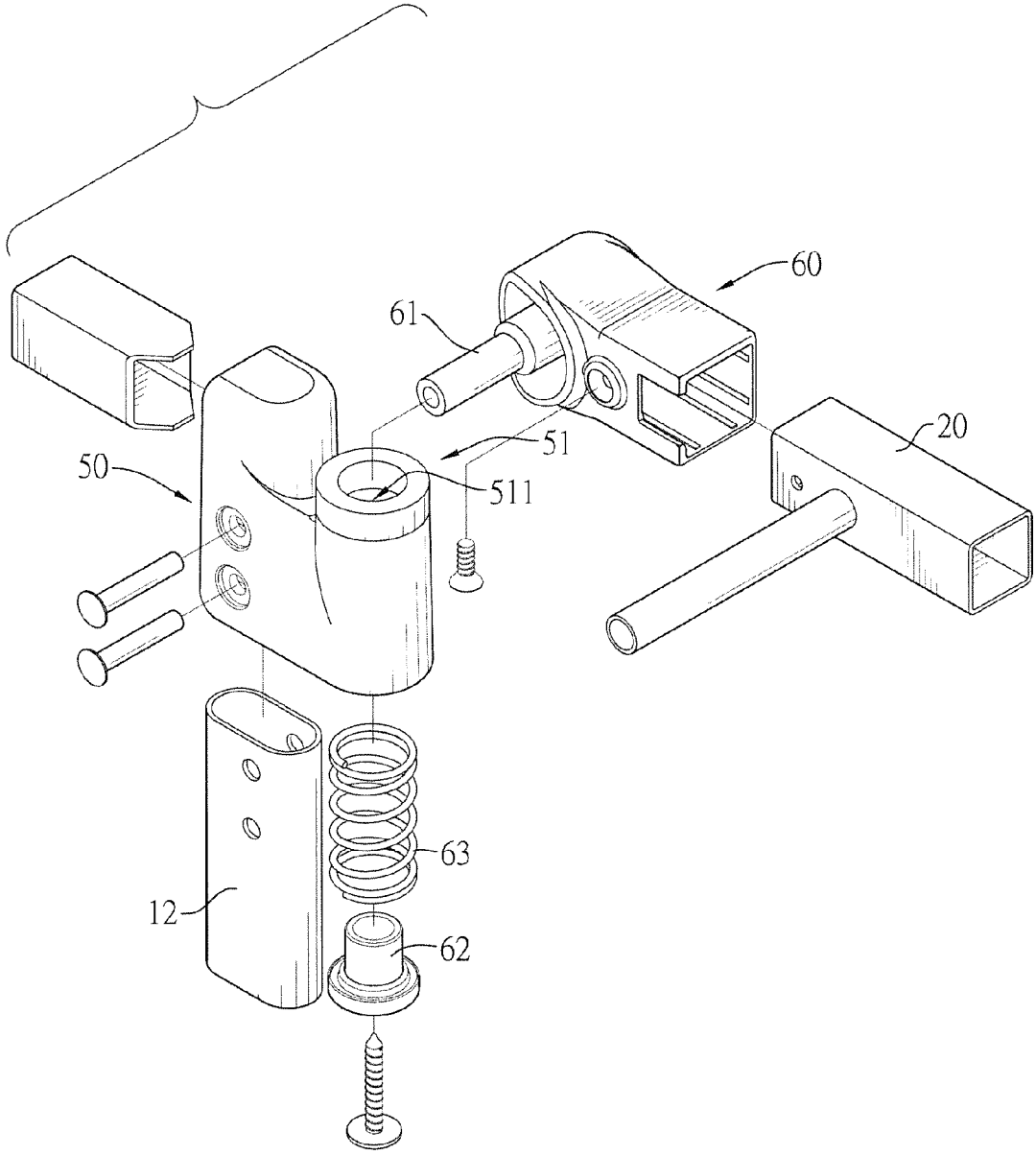
FIG. 4 is an exploded perspective view of an upper pivot unit of the safety gate in FIG. 1.
Figure 5:
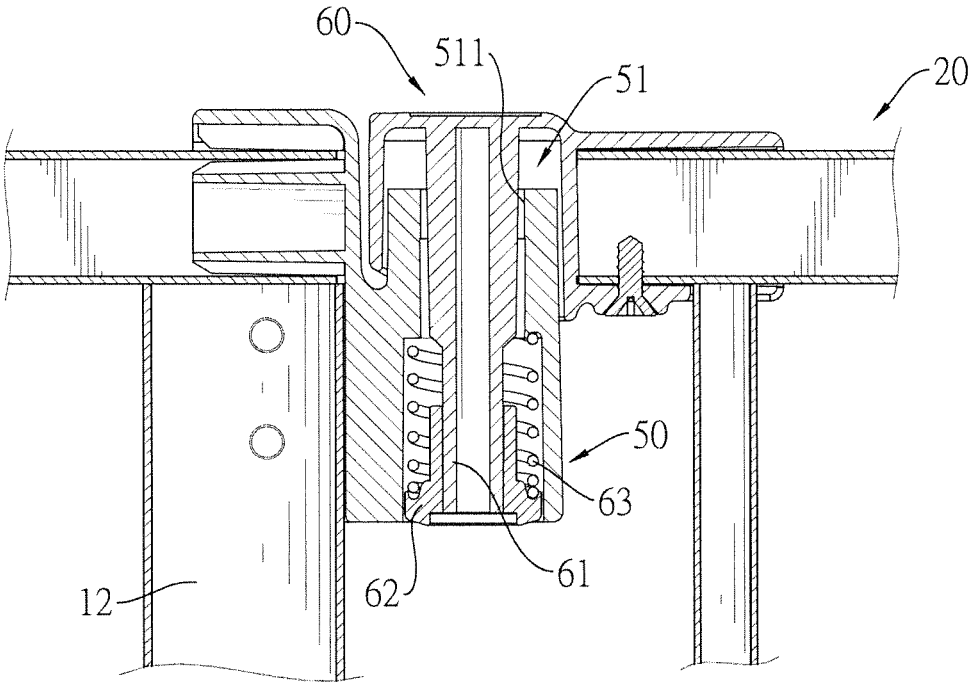
FIG. 5 is a front view in partial section of the upper pivot unit of the safety gate in FIG. 1.

With reference to FIGS. 4 and 5, in a preferred embodiment, the doorframe 10 further has an upper pivot seat 50. The upper pivot seat 50 is mounted on a top of the first side frame 12, is hollow and has an upper abutter 51 and an upper hole 511. The upper abutter 51 is formed on a top of a side of the upper pivot seat 50. The upper hole 511 is formed through the upper pivot seat 50 and the upper abutter 51. A radius of the upper hole 511 is smaller than an inside radius of the upper pivot seat 50.

In a preferred embodiment, the fence door 20 further has an upper pivot unit 60. The upper pivot unit 60 is mounted on a top of the fence door 20, is adjacent to the first side frame 12 and has an upper pivot 61, an upper limit 62 and an upper resilient element 63. The upper pivot 61 is formed on a center of a bottom of the upper pivot unit 60 and is rotatably mounted in the upper hole 511 of the upper pivot seat 50. The upper limit 62 is mounted on a bottom of the upper pivot 61 and is mounted in the upper pivot seat 50. The upper resilient element 63 is mounted around the upper pivot 61 and abuts a top of the upper limit 62 and a bottom of the upper abutter 51 of the upper pivot seat 50.

Figure 6:
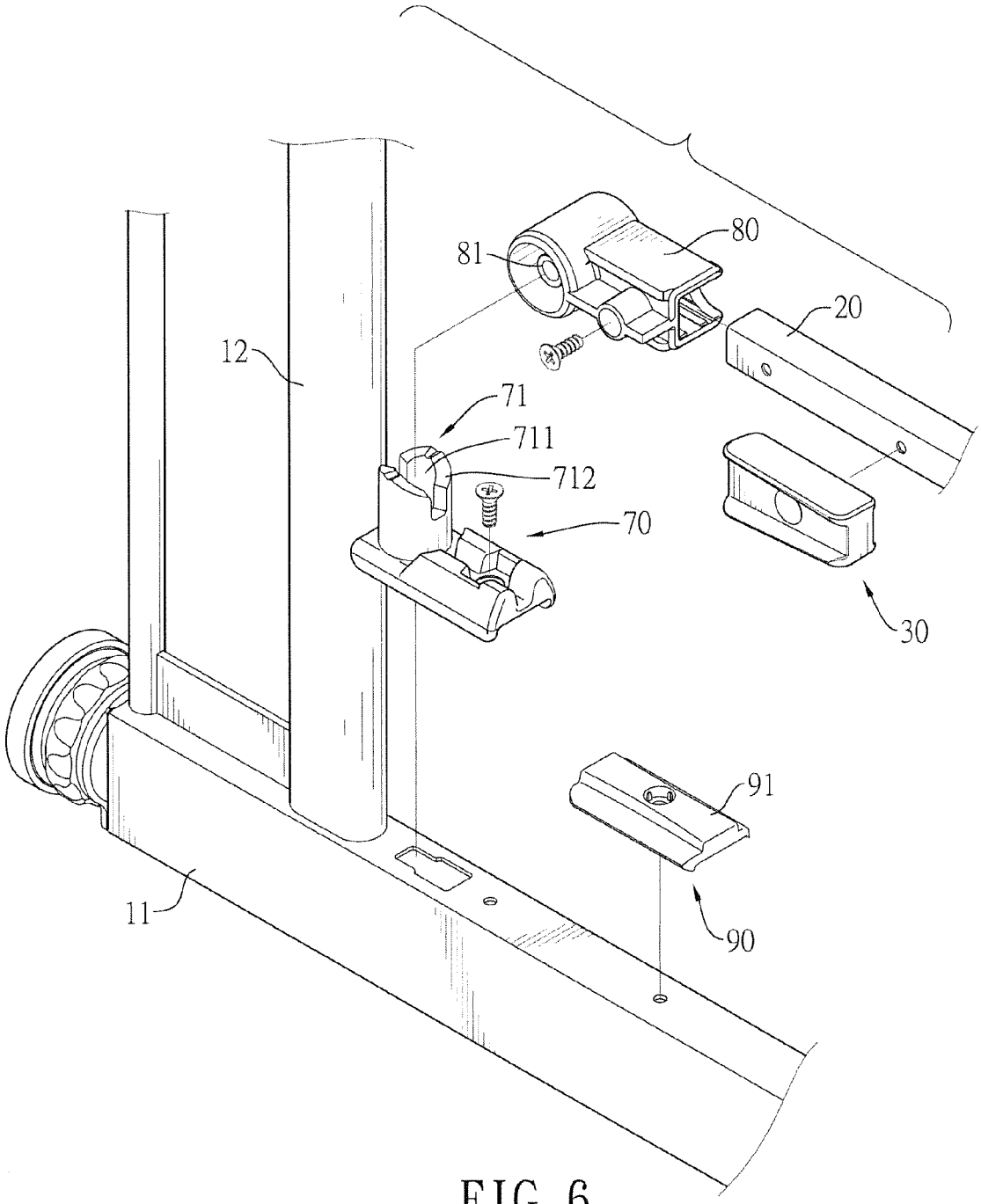
FIG. 6 is an exploded perspective view of a lower pivot unit of the safety gate in FIG. 1.
Figure 7:
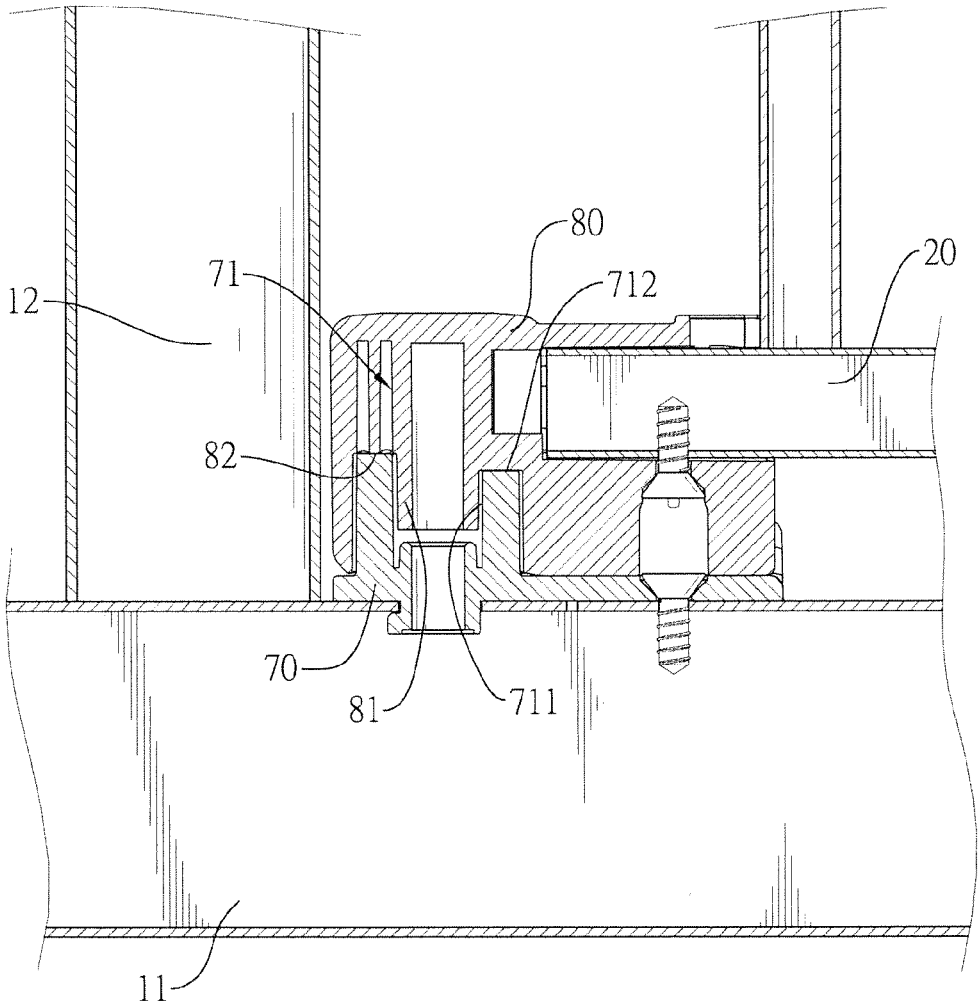
FIG. 7 is a front view in partial section of the lower pivot unit of the safety gate in FIG. 1.

With reference to FIGS. 6 and 7, in a preferred embodiment, the door frame 10 further has a lower pivot seat 70. The lower pivot seat 70 is mounted on the base frame 11, is adjacent to the first side frame 12, is hollow and has a lower abutter 71, a lower hole 711, and two lower inclines 712. The lower abutter 71 is formed on a top of a side of the lower pivot seat 70. The lower hole 711 is formed through the lower pivot seat 70 and the lower abutter 71. The lower inclines 712 are formed on a top of the lower abutter 71.

In a preferred embodiment, the fence door 20 further has a lower pivot unit 80. The lower pivot unit 80 is mounted on the bottom of the fence door 20, is adjacent to the first side frame 12 and has a lower pivot 81 and two lower ribs 82. The lower pivot 81 is formed on a center of a bottom of the lower pivot unit 80 and is rotatably mounted in the lower hole 711 of the lower pivot seat 70. The lower ribs 82 are formed on the bottom of the lower pivot unit 80, have different heights and selectively abut the lower inclines 712 of the lower pivot seat 70. A bottom of each lower rib 82 is inclined and corresponds to the lower incline 712 in inclination angle.

Figure 8:
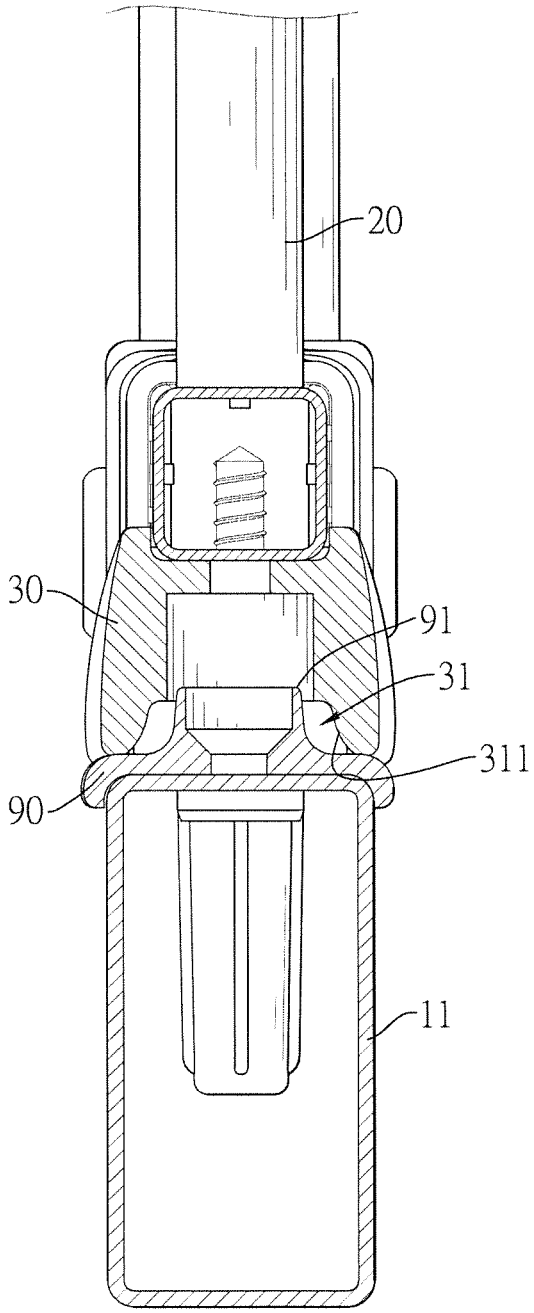
FIG. 8 is a side view in partial section of a repositioning unit and a repositioning seat of the safety gate in FIG. 1.
Figure 9:
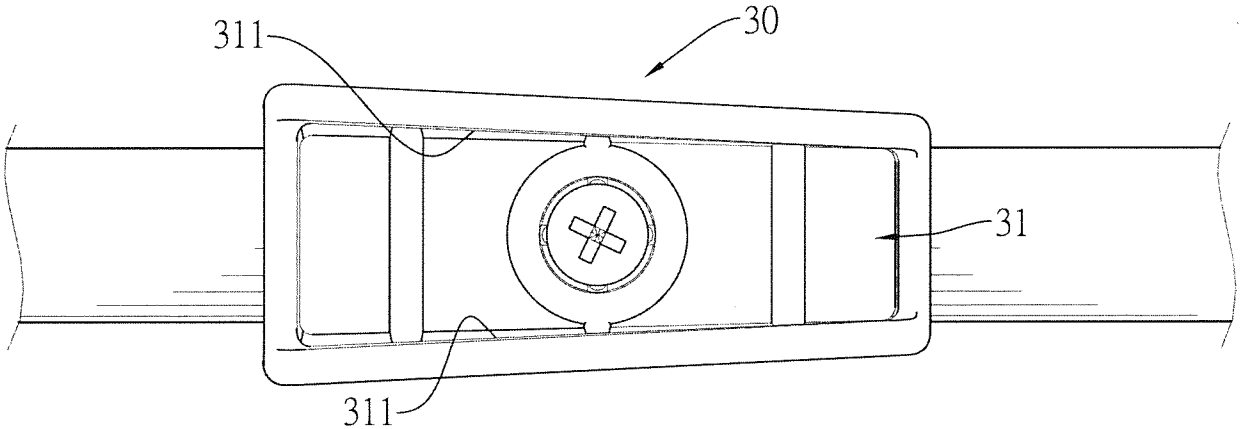
FIG. 9 is a bottom view of the repositioning unit of the safety gate in FIG. 1.
Figure 10:
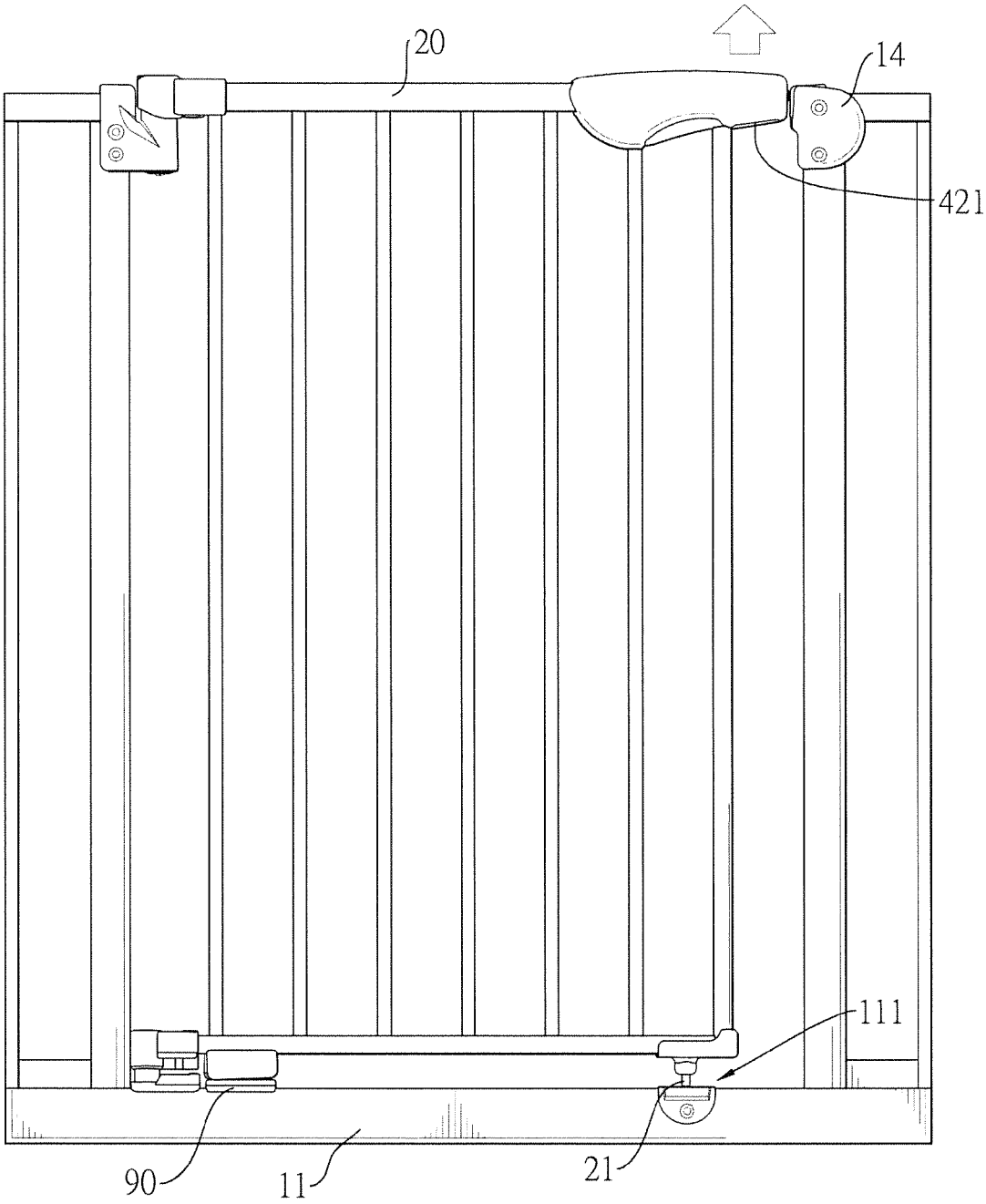
FIG. 10 is a front view of the safety gate in FIG. 1, showing a fence door lifted up.

With reference to FIGS. 2, 6 and 8, the repositioning seat 90 is mounted on the top of the base frame 11, is adjacent to the first side frame 12 and has a repositioning protrusion 91. The repositioning protrusion 91 is formed on a top of the repositioning seat 90 and is elongated along the base frame 11. A width of the repositioning protrusion 91 is decreased gradually along a direction from the second side frame 13 to the first side frame 12.

With reference to FIGS. 1, 6, 8 and 9, the repositioning unit 30 is mounted on the bottom of the fence door 20, is adjacent to the first side frame 12 and has a repositioning recess 31. The repositioning recess 31 is formed in a bottom of the repositioning unit 30, is elongated along the fence door 20, communicates with the exterior environment via two ends of the repositioning unit 30, selectively engages the repositioning protrusion 91 of the repositioning seat 90 and has two guiding surfaces 311. The guiding surfaces 311 face each other, and are curved and inclined relative to the fence door 20. A distance between the guiding surfaces 311 is decreased gradually along a direction from the first side frame 12 to the second side frame 13 and is decreased gradually from bottom to top.

With reference to FIGS. 3 to 6 and 10, to open the fence door 20, the exposed pusher 421 of the second latch 42 is pushed such that the second latch 42 departs from the second hole 142 of the receiver 14, thereby unlocking the second latch 42. Then the fence door 20 is lifted up with the second latch 42 departing from the receiver 14, thereby further accomplishing three unlocking acts. First, the lock plunger 21 on the bottom of the fence door 20 departs from the lock recess 111 of the base frame 11. Second, the repositioning recess 31 of the repositioning unit 30 disengages the repositioning protrusion 91 of the repositioning seat 90. Third, the first latch 41 abuts the unlocking inclined surface 143, is pushed back by the unlocking inclined surface 143 and finally departs from the first hole 141. On the other hand, the upper resilient element 63 of the upper pivot unit 60 is compressed and stores elastic potential energy as shown in FIGS. 4 and 5. At this time, all the locked elements are unlocked and the user can push to open the fence door 20.

With reference to FIGS. 4 to 7, when the user stops pushing the fence door 20, the stored elastic potential energy of the upper resilient element 63 may be released and push down the fence door 20 if the fence door 20 is open at a relatively large angle. When the fence door 20 is moved down, the lower ribs 82 move along the lower inclines 712 to reversely rotate the fence door 20 and the fence door 20 is rotated to close automatically therefore.

Figure 11:
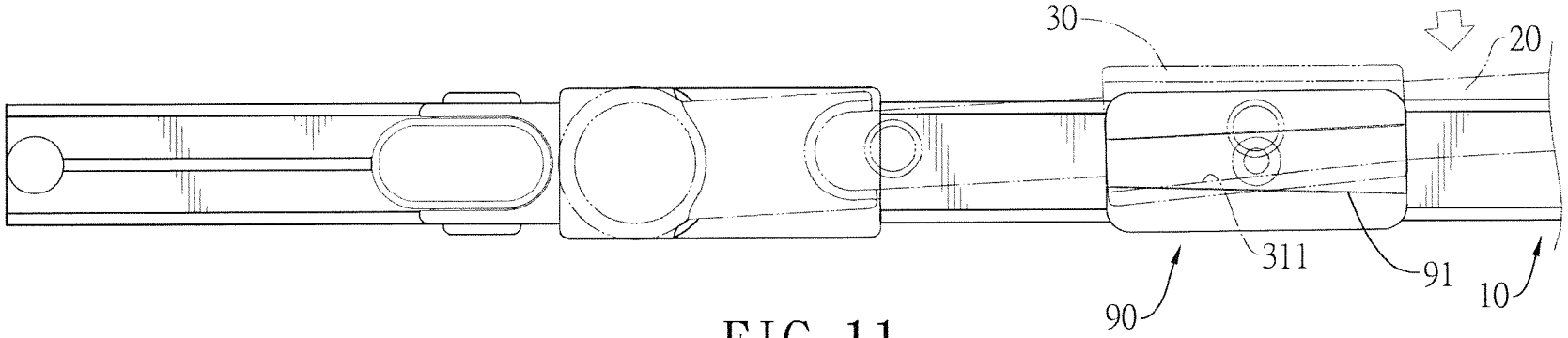
FIG. 11 is an operational top view of the safety gate in FIG. 1, showing a first act of the repositioning unit guiding the repositioning seat.
Figure 12:
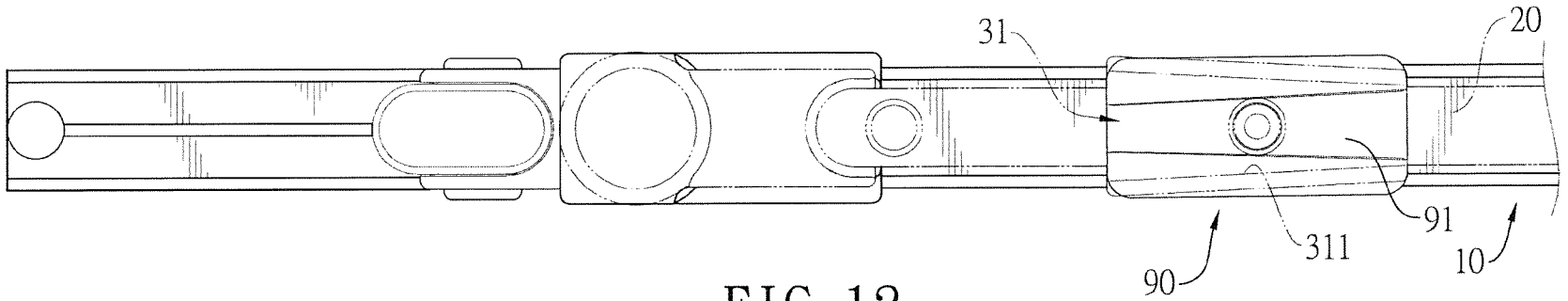
FIG. 12 is another operational top view of the safety gate in FIG. 1, showing a second act of the repositioning unit guiding the repositioning seat.

With reference to FIGS. 8, 11 and 12, if the fence door 20 is open at a relatively small angle, for example, under 5 degrees, the elastic potential energy may not be big enough to move the fence door 20. At this time, one of the guiding surfaces 311 of the repositioning unit 30 abuts a side of the top of the base frame 11 as shown in FIG. 11. Because the guiding surface 311 is curved and inclined relative to the fence door 20 and because the distance between the two guiding surfaces 311 is decreased gradually along the direction from the first side frame 12 to the second side frame 13, the guiding surface 311 gradually slides along the abutted side of the top of the base frame 11 and is therefore pushed by the base frame 11. The repositioning unit 30 and the fence door 20 are pushed to rotate and finally the repositioning recess 31 engages the protrusion 91 of the repositioning seat 90 as shown in FIGS. 8 and 12. As a result, the fence door 20 is rotated reversely to close.

With further reference to FIGS. 1 and 2, the fence door 20 is moved downward during the closing. Thus, when the fence door 20 is rotated to close, the lock plunger 21 on the bottom of the fence door 20 engages the lock recess 111 of the base frame 11, thereby locking the fence door 20 and the doorframe 10. With reference to FIGS. 1 to 3, during the closing of the fence door 20, the first latch 41 and the second latch 42 of the lock assembly 40 abut and slide on one of the curved abutting surfaces 144 and the latches 41, 42 are pushed back by the curved abutting surface 144. After the latches 41, 42 depart from the curved abutting surface 144, the latches 41, 42 are each respectively pushed by the springs 43, 44 and are each respectively mounted in the first hole 141 and the second hole 142 to lock the fence door 20 and the door frame 10.

Figure 13:
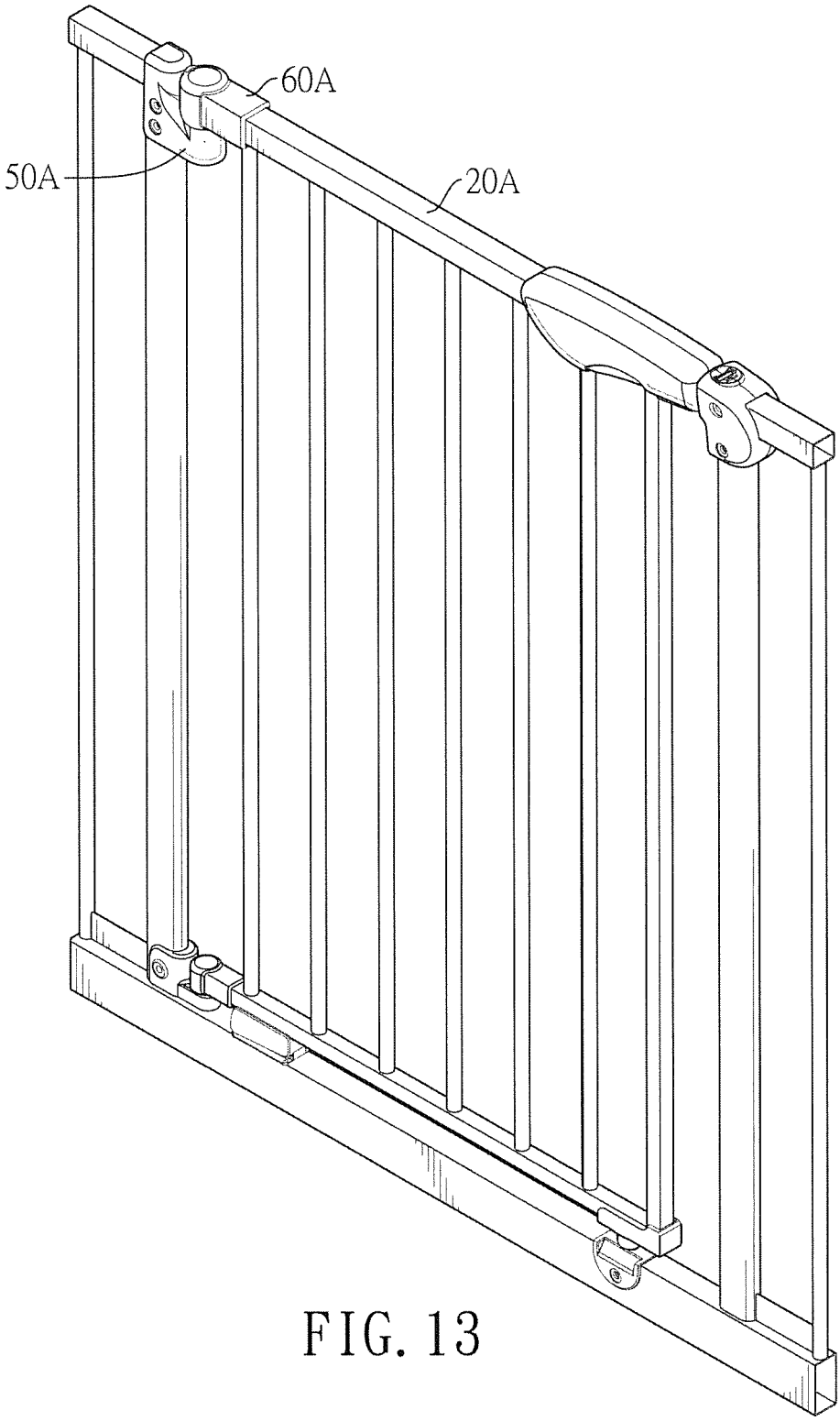
FIG. 13 is a perspective view of a second embodiment of the safety gate in accordance with the present invention.
Figure 14:
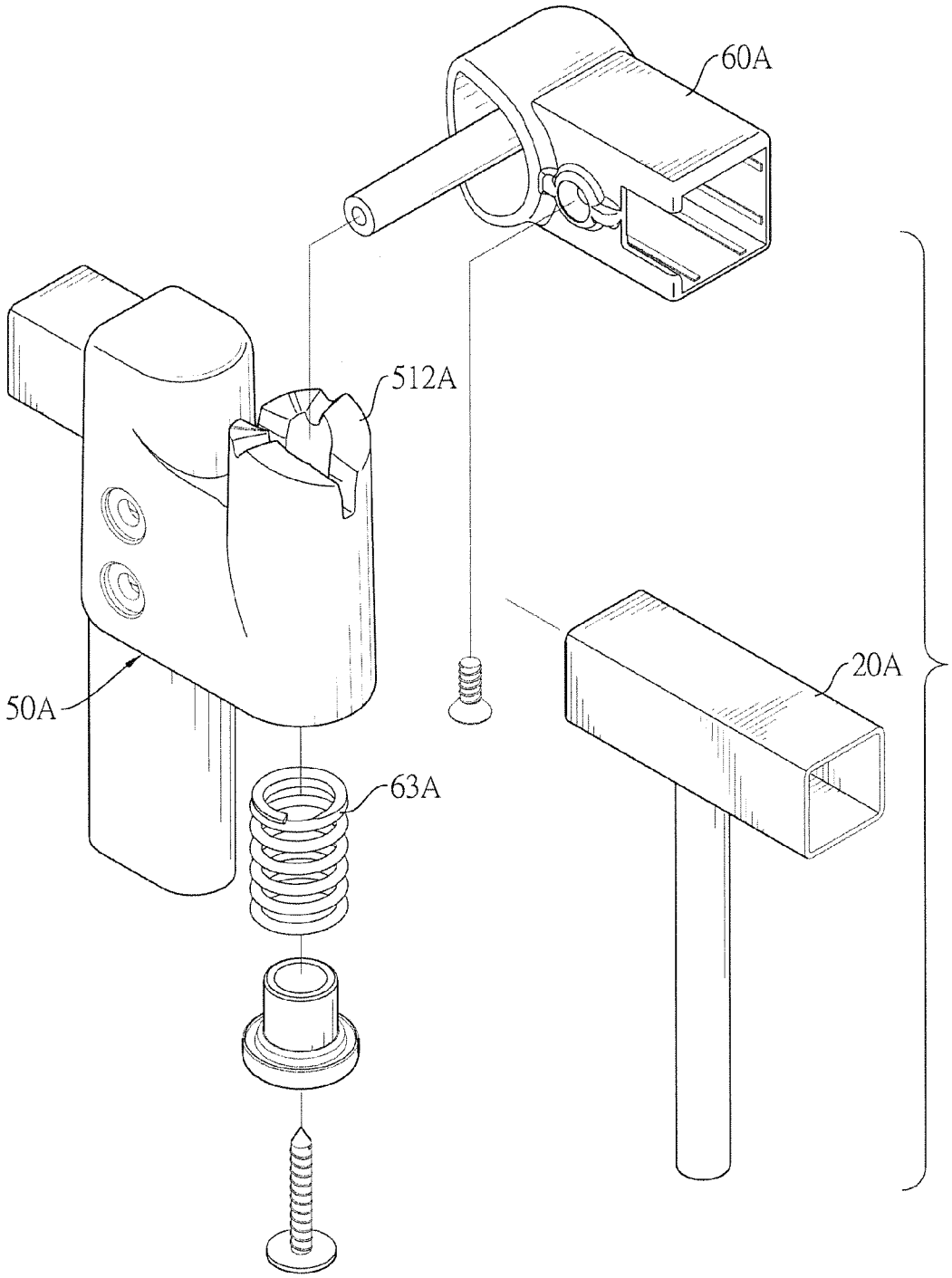
FIG. 14 is an exploded perspective view of the upper pivot unit of the safety gate in FIG. 13.
Figure 15:
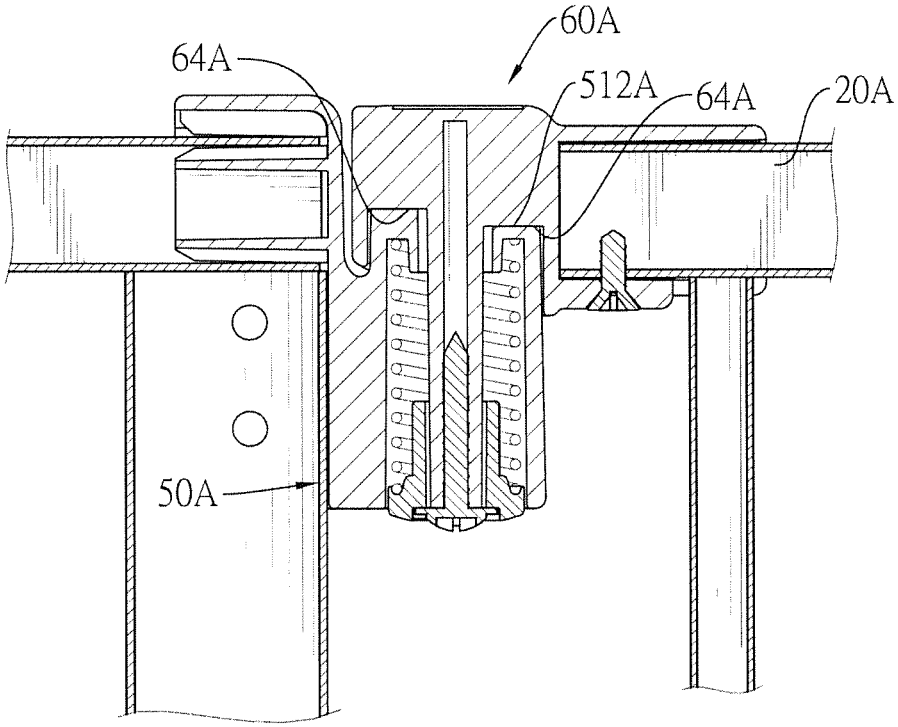
FIG. 15 is a front view in partial section of the upper pivot unit of the safety gate in FIG. 13.

With reference to FIGS. 13 to 15, a second embodiment of the safety gate in accordance with the present invention is similar to the first embodiment as mentioned above. However, the two embodiments have some differences as follows.

Figure 16:
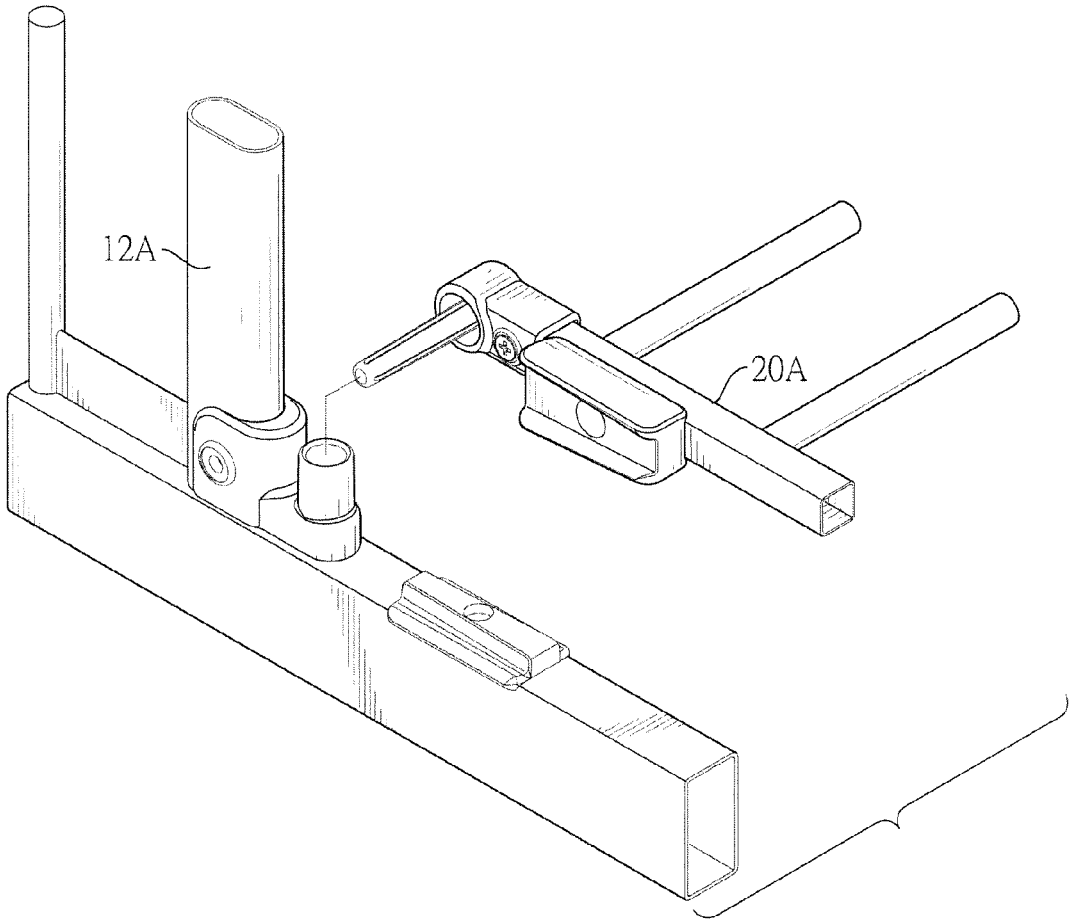
FIG. 16 is an exploded perspective view of the safety gate in FIG. 13, showing the repositioning unit.

With reference to FIG. 16, the second embodiment has no lower pivot seat and no lower pivot unit and has an ordinary pivot device in replacement of the lower pivot seat and the lower pivot unit. The ordinary pivot device also allows the fence door 20A to rotate and axially move relative to the first side frame 12A.

With reference to FIGS. 13 to 15, the upper pivot seat 50A has two upper inclines 512A to replace the lower inclines of the lower pivot seat of the first embodiment. The upper pivot unit 60A has two upper ribs 64A to replace the lower ribs of the lower pivot unit of the first embodiment. Thus, besides the upper resilient element 63A, the upper pivot seat 50A and the upper pivot unit 60A also can rotate the fence door 20A during the course when the fence door 20A is moving down.

The second embodiment and the first embodiment have some difference in structure, but the second embodiment also can achieve the same function as the first embodiment.

Figure 17:
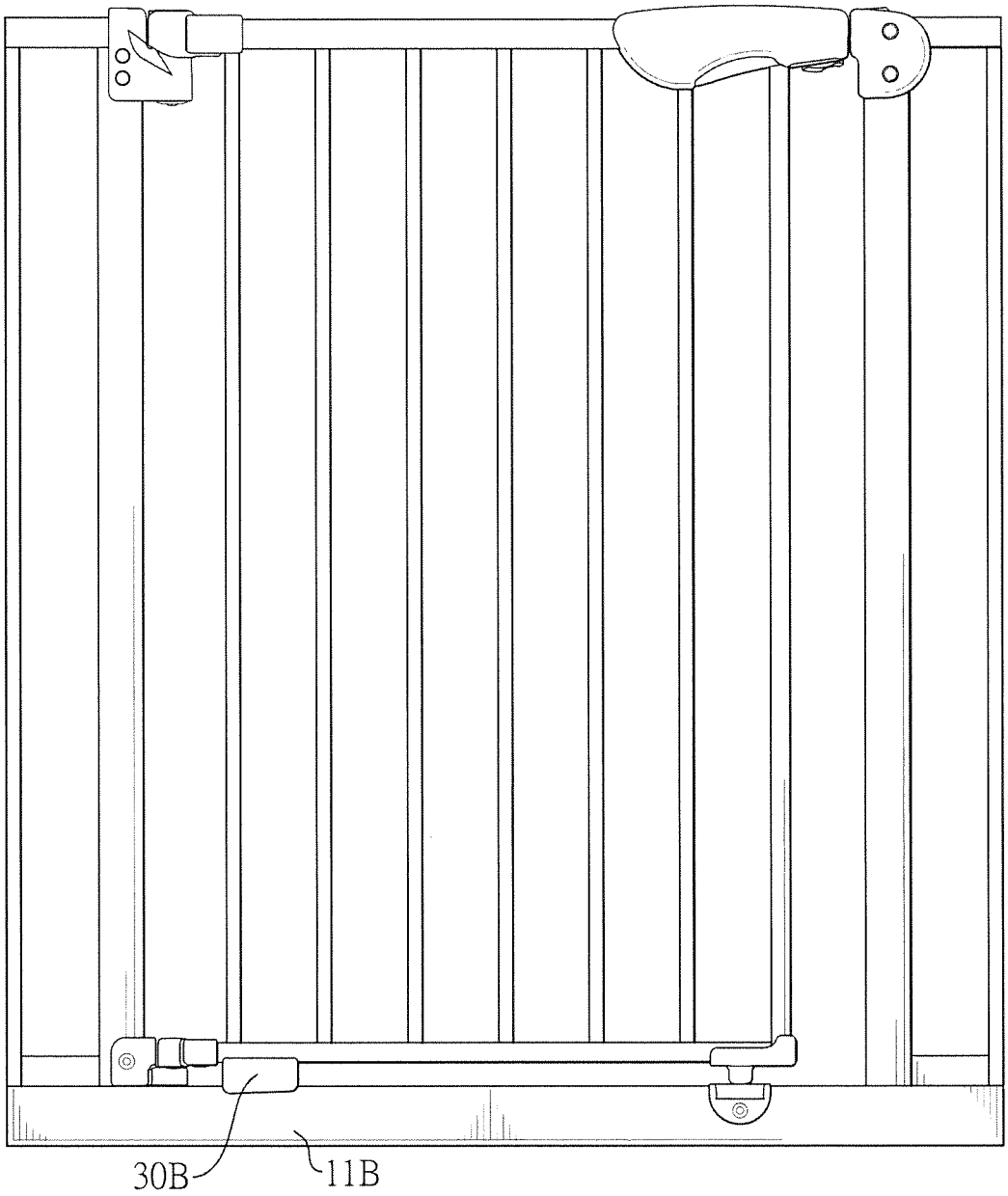
FIG. 17 is a front view of a third embodiment of the safety gate in accordance with the present invention.
Figure 18:
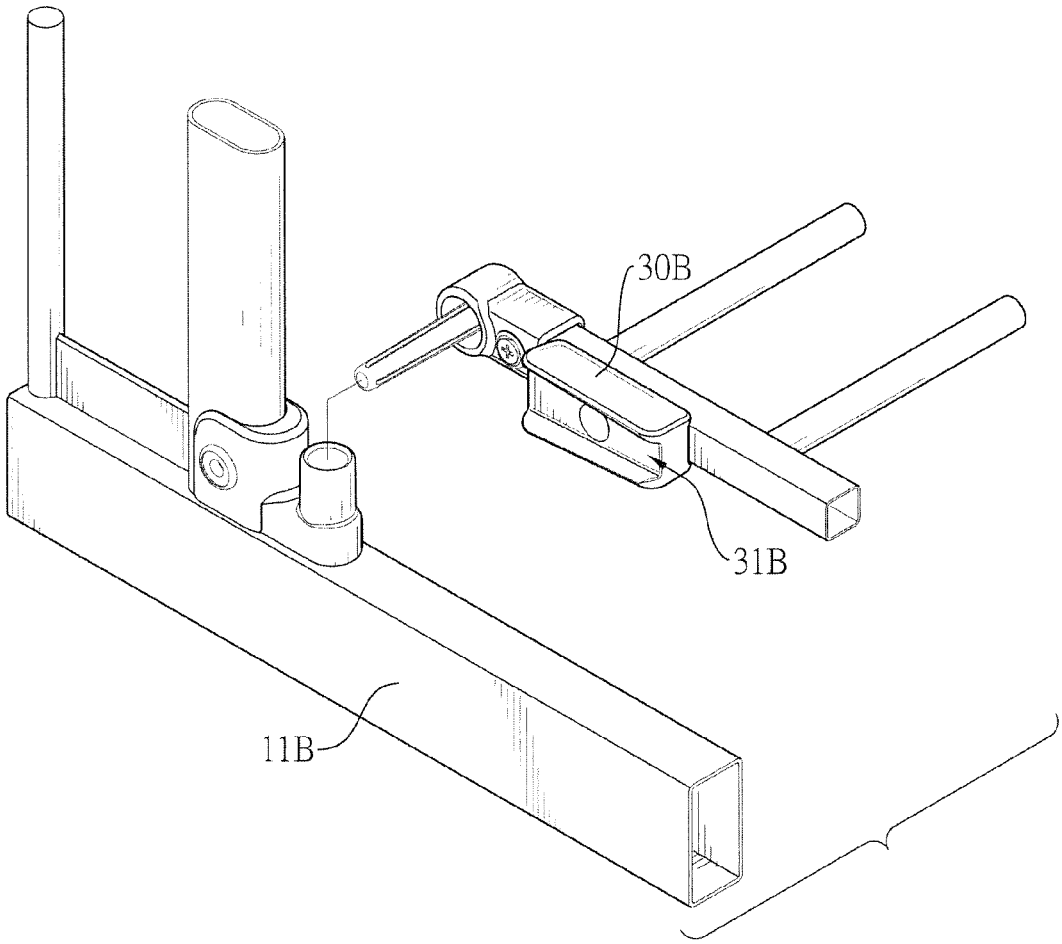
FIG. 18 is an exploded perspective view of the safety gate in FIG. 17, showing the repositioning unit.
Figure 19:
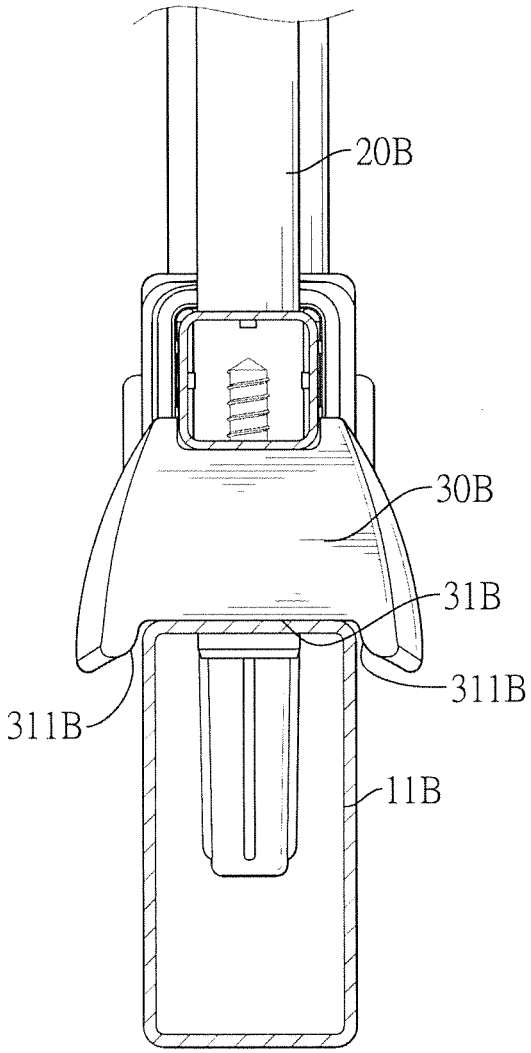
FIG. 19 is a side view in partial section of the safety gate in FIG. 17, showing the repositioning unit.

With reference to FIGS. 17 to 19, a third embodiment of the safety gate in accordance with the present invention is similar to the second embodiment as mentioned above. The main difference resides in that the third embodiment has no repositioning seat, and the repositioning recess 31B of the repositioning unit 30B engages the top of the base frame 11B.

Figure 20:
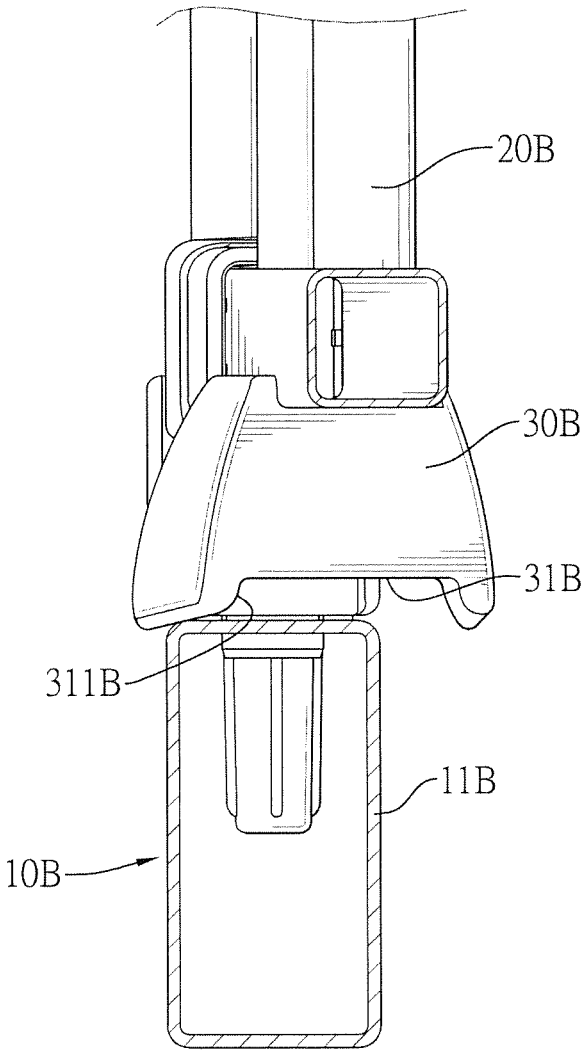
FIG. 20 is an operational side view in partial section of the safety gate in FIG. 17, showing a first act of the repositioning unit.
Figure 21:
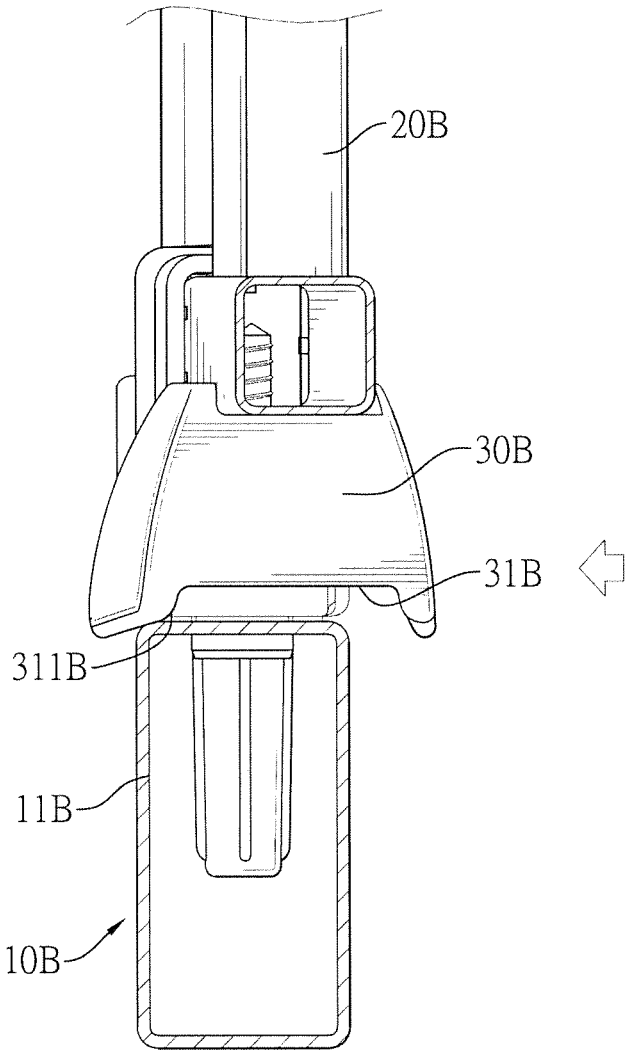
FIG. 21 is another operational side view in partial section of the safety gate in FIG. 17, showing a second act of the repositioning unit.

With reference to FIGS. 19 to 21, when the fence door 20B is slightly open at a small angle, such as under 5 degrees, one of the guiding surfaces 311B of the repositioning unit 30B abuts a side of the top of the base frame 11B. Because the guiding surface 311B is curved and inclined relative to the fence door 20B and because the distance between the two guiding surfaces 311B is decreased gradually along the direction from the first side frame to the second side frame, the guiding surface 311B gradually rotates the fence door 20B as shown in FIG. 21. The repositioning unit 30B is rotated with the fence door 20B such that finally the guiding surfaces 311E clamp and engage with the base frame 11B, which means the fence door 20B is rotated to close.

The third embodiment also can achieve the same function as the second embodiment and the first embodiment.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A safety gate comprising:

a doorframe having
- a base frame having two ends;
- a first side frame vertically mounted on one of the ends of the base frame; and
- a second side frame vertically mounted on the other one of the ends of the base frame;

a fence door having
- a first side rotatably connected to the first side frame in an axially moveable manner; and
- a second side opposite to the first side; and a repositioning unit mounted on a bottom of the fence door, being adjacent to the first side frame, and having
- a repositioning recess formed in a bottom of the repositioning unit, being elongated along the fence door, communicating with an exterior environment via two ends of the repositioning unit, selectively engaging a top of the base frame and having
  - two guiding surfaces facing each other, being curved and inclined relative to the fence door; and
  - a distance between the guiding surfaces being decreased gradually along a direction from the first side frame to the second side frame, and being decreased gradually from bottom to top.

2. The safety gate as claimed in claim 1, wherein the doorframe has
- an upper pivot seat mounted on a top of the first side frame, being hollow and having
  - an upper abutter formed on a top of a side of the upper pivot seat; and
  - an upper hole formed through the upper pivot seat and the upper abutter; and
- a lower pivot seat mounted on the base frame, being adjacent to the first side frame, being hollow and having
  - a lower abutter formed on a top of a side of the lower pivot seat;
  - a lower hole formed through the lower pivot seat and the lower abutter; and
  - two lower inclines formed on a top of the lower abutter; and the fence door has
- an upper pivot unit mounted on a top of the fence door and having
  - an upper pivot formed on a center of a bottom of the upper pivot unit and rotatably mounted in the upper hole of the upper pivot seat;
  - an upper limit mounted on a bottom of the upper pivot and mounted in the upper pivot seat; and
  - an upper resilient element mounted around the upper pivot and abutting a top of the upper limit and a bottom of the upper abutter; and
- a lower pivot unit mounted on the bottom of the fence door and having a lower pivot formed on a center of a bottom of the lower pivot unit and rotatably mounted in the lower hole of the lower pivot seat; and two lower ribs formed on the bottom of the lower pivot unit, having different heights and selectively abutting the lower inclines of the lower pivot seat.

3. The safety gate as claimed in claim 2, wherein the base frame has a lock recess disposed in the top of the base frame; and the fence door has a lock plunger mounted on the bottom of the fence door, being adjacent to the second side frame and selectively engaging in the lock recess of the base frame.

4. The safety gate as claimed in claim 3, wherein the second side frame has a first hole disposed in a side of the second side frame and being adjacent to a top of the second side frame;

the fence door has a lock assembly mounted on the second side of the fence door and having a first latch being telescopic and selectively mounted in the first hole of the second side frame.

5. The safety gate as claimed in claim 4, wherein the second side frame has a second hole disposed in the side of the second side frame;

the lock assembly has a second latch being telescopic and selectively mounted in the second hole of the second side frame.

6. The safety gate as claimed in claim 1, wherein the doorframe has an upper pivot seat mounted on a top of the first side frame, being hollow and having an upper abutter formed on a top of a side of the upper pivot seat;

an upper hole formed through the upper pivot seat and the upper abutter; and two upper inclines formed on a top of the upper abutter; and the fence door has an upper pivot unit mounted on a top of the fence door and having an upper pivot formed on a center of a bottom of the upper pivot unit and rotatably mounted in the upper hole of the upper pivot seat;

two upper ribs formed on the bottom of the upper pivot unit, having different heights and selectively abutting the upper inclines of the upper pivot seat;

an upper limit mounted on a bottom of the upper pivot and mounted in the upper pivot seat; and an upper resilient element mounted around the upper pivot and abutting a top of the upper limit and a bottom of the upper abutter.

7. The safety gate as claimed in claim 6, wherein a bottom end of a side of the first side frame is pivotally connected to a bottom end of the first side of the fence door.

8. The safety gate as claimed in claim 1, wherein the base frame has a lock recess disposed in the top of the base frame; and the fence door has a lock plunger mounted on the bottom of the fence door, being adjacent to the second side frame and selectively engaging in the lock recess of the base frame.

9. The safety gate as claimed in claim 1, wherein the second side frame has a first hole disposed in a side of the second side frame and being adjacent to a top of the second side frame;

the fence door has a lock assembly mounted on the second side of the fence door and having a first latch being telescopic and selectively mounted in the first hole of the second side frame.

10. The safety gate as claimed in claim 9, wherein the second side frame has a second hole disposed in the side of the second side frame;

the lock assembly has a second latch being telescopic and selectively mounted in the second hole of the second side frame.

11. A safety gate comprising:

a doorframe having a base frame having two ends;

a first side frame vertically mounted on one of the ends of the base frame; and a second side frame vertically mounted on the other one of the ends of the base frame;

a fence door having a first side rotatably connected to the first side frame in an axially moveable manner; and a second side opposite to the first side;

a repositioning seat mounted on a top of the base frame, being adjacent to the first side frame, and having a repositioning protrusion formed on a top of the repositioning seat and being elongated along the base frame; and a width of the repositioning protrusion being decreased gradually along a direction from the second side frame to the first side frame; and a repositioning unit mounted on a bottom of the fence door, being adjacent to the first side frame, and having a repositioning recess formed in a bottom of the repositioning unit, being elongated along the fence door, communicating with an exterior environment via two ends of the repositioning unit, selectively engaging the repositioning protrusion of the repositioning seat, and having two guiding surfaces facing each other, being curved and inclined relative to the fence door; and a distance between the guiding surfaces being decreased gradually along a direction from the first side frame to the second side frame, and being decreased gradually from bottom to top.

12. The safety gate as claimed in claim 11, wherein the doorframe has an upper pivot seat mounted on a top of the first side frame, being hollow and having an upper abutter formed on a top of a side of the upper pivot seat; and an upper hole formed through the upper pivot seat and the upper abutter; and a lower pivot seat mounted on the base frame, being adjacent to the first side frame, being hollow and having a lower abutter formed on a top of a side of the lower pivot seat;

a lower hole formed through the lower pivot seat and the lower abutter; and two lower inclines formed on a top of the lower abutter; and the fence door has an upper pivot unit mounted on a top of the fence door and having an upper pivot formed on a center of a bottom of the upper pivot unit and rotatably mounted in the upper hole of the upper pivot seat;

an upper limit mounted on a bottom of the upper pivot and mounted in the upper pivot seat; and an upper resilient element mounted around the upper pivot and abutting a top of the upper limit and a bottom of the upper abutter; and a lower pivot unit mounted on the bottom of the fence door and having a lower pivot formed on a center of a bottom of the lower pivot unit and rotatably mounted in the lower hole of the lower pivot seat; and two lower ribs formed on the bottom of the lower pivot unit, having different heights and selectively abutting the lower inclines of the lower pivot seat.

13. The safety gate as claimed in claim 12, wherein the base frame has a lock recess disposed in the top of the base frame; and the fence door has a lock plunger mounted on the bottom of the fence door, being adjacent to the second side frame and selectively engaging in the lock recess of the base frame.

14. The safety gate as claimed in claim 13, wherein the second side frame has a first hole disposed in a side of the second side frame and being adjacent to a top of the second side frame;

the fence door has a lock assembly mounted on the second side of the fence door and having a first latch being telescopic and selectively mounted in the first hole of the second side frame.

15. The safety gate as claimed in claim 14, wherein the second side frame has a second hole disposed in the side of the second side frame;

the lock assembly has a second latch being telescopic and selectively mounted in the second hole of the second side frame.

16. The safety gate as claimed in claim 11, wherein the doorframe has an upper pivot seat mounted on a top of the first side frame, being hollow and having an upper abutter formed on a top of a side of the upper pivot seat;

an upper hole formed through the upper pivot seat and the upper abutter; and two upper inclines formed on a top of the upper abutter; and the fence door has an upper pivot unit mounted on a top of the fence door and having an upper pivot formed on a center of a bottom of the upper pivot unit and rotatably mounted in the upper hole of the upper pivot seat;

two upper ribs formed on the bottom of the upper pivot unit, having different heights and selectively abutting the upper inclines of the upper pivot seat;

an upper limit mounted on a bottom of the upper pivot and mounted in the upper pivot seat; and an upper resilient element mounted around the upper pivot and abutting a top of the upper limit and a bottom of the upper abutter.

17. The safety gate as claimed in claim 16, wherein a bottom end of a side of the first side frame is pivotally connected to a bottom end of the first side of the fence door.

18. The safety gate as claimed in claim 11, wherein the base frame has a lock recess disposed in the top of the base frame; and the fence door has a lock plunger mounted on the bottom of the fence door, being adjacent to the second side frame and selectively engaging in the lock recess of the base frame.

19. The safety gate as claimed in claim 11, wherein the second side frame has a first hole disposed in a side of the second side frame and being adjacent to a top of the second side frame;

the fence door has a lock assembly mounted on the second side of the fence door and having a first latch being telescopic and selectively mounted in the first hole of the second side frame.

20. The safety gate as claimed in claim 19, wherein the second side frame has a second hole disposed in the side of the second side frame;

the lock assembly has a second latch being telescopic and selectively mounted in the second hole of the second side frame.

* * * * *